United States Patent [19]

Board

[11] 3,996,508

[45] Dec. 7, 1976

[54] THREE PHASE PRIMARY POWER REGULATOR

[75] Inventor: Ralph Board, Park Ridge, Ill.

[73] Assignee: Northrop Corporation, Rolling Meadows, Ill.

[22] Filed: Nov. 20, 1972

[21] Appl. No.: 308,147

[52] U.S. Cl. ..... 323/6; 317/31; 317/33 VR; 321/18; 323/22 T; 323/62

[51] Int. Cl.[2] ..... G05F 1/48

[58] Field of Search ..... 317/31, 33 VR; 321/5, 321/18; 323/6, 8, 22 T, 44 R, 62

[56] References Cited

UNITED STATES PATENTS

| | | | |
|---|---|---|---|
| 3,065,399 | 11/1962 | McNamee | 321/18 |
| 3,113,260 | 12/1963 | Wiley | 317/33 VR |
| 3,244,962 | 4/1966 | Genuit | 323/44 R |
| 3,343,063 | 9/1967 | Keeney et al. | 321/18 X |
| 3,375,428 | 3/1968 | Mitchell | 321/18 |
| 3,408,559 | 10/1968 | Bambace et al. | 323/22 T |
| 3,514,689 | 5/1970 | Giannamore | 321/18 X |
| 3,582,713 | 6/1971 | Till | 317/33 VR |
| 3,597,655 | 8/1971 | Forte | 317/33 VR |
| 3,676,766 | 7/1972 | Blackmond | 323/6 |

*Primary Examiner*—A. D. Pellinen
*Attorney, Agent, or Firm*—Wegner, Stellman, McCord, Wiles & Wood

[57] ABSTRACT

A regulated three phase power supply with a wye connected, isolated neutral transformer having a full wave three phase bridge connected between the phase windings and the common point. A clipper transistor is connected across the bridge so that each phase current flows through the transistor. A drive circuit for the clipper transistor is isolated from ground. Reducing the drive to the clipper transistor increases its impedance and clips the voltage wave across the transformer primary. An output circuit is connected with the transformer. A three phase feedbck circuit is connected from either the output circuit or the wye connected circuit to the clipper transistor and is responsive to the instantaneous phase voltages to increase the transistor impedance, clipping the input voltage, when the sensed condition is excessive.

Current regulation is provided by increasing the drive to the transistor as the current through it increases. Overload and overvoltage sensing circuits increase the impedance of the clipping transistor in the event of an overload or transient overvoltage condition. A combination of delta and wye three phase, full wave rectified feedback circuits provide six phase feedback and a high efficiency of control. Plural outputs may be obtained from the transformer; and delta and wye output circuits can be connected to increase the ripple frequency.

30 Claims, 12 Drawing Figures

THREE PHASE PRIMARY POWER REGULATOR

This invention is concerned with a regulated power supply and more particularly with a three phase system having a clipper device connected with the primary of a wye connected isolated neutral transformer.

Regulated power supplies are known in which are variable impedance element is connected with the source and the impedance is modified or modulated to regulate the output. Kerns 2,579,235 shows a three phase power system having a control tube, the bias of which is varied to vary the unidirectional voltage output of the system. Details of the bias circuit are not disclosed. Wanlass 3,461,376 shows a single phase regulator system having a transistor connected in series with the source, together with a circuit for controlling the transistor to limit the input voltage.

The present invention is concerned with a three phase power system having a improved clipping control to achieve stable, efficient regulation. The system operates with a negligible time delay, responding rapidly to transient voltage surges. More particularly, the regulator includes a clipper device connected through a bridge circuit with the primary windings of a wye connected, isolated neutral three phase transformer. The impedance of the clipper device is varied to regulate the output fom the transformer by a drive circuit which is isolated from ground.

Another feature is that the clipper device impedance is varied by a three phase feedback circuit to limit each phase of the voltage appearing in the output circuit. A further feature is the provision of two three phase feedback circuits, one displaced in phase from the other, providing six phase limiting of the voltage to the output circuit.

Yet another feature of the invention is the provision of means responsive to abnormal or excessive current or voltage conditions to turn off the power supply.

Still a further feature is that the feedback circuit includes a three phase transformer connected with the output circuit and the three phase, full wave rectifier connected between the transformer and the clipping circuit. The output of the rectifier controls the impedance of a clipper transistor as a function of the output voltage to limit the output voltage.

And another feature is that the circuit includes a source of operating potential connected with the clipper transistor and having a circuit for applying a potential to the base of the transistor, causing it to conduct. The feedback circuit includes means establishing a reference potential and further means responsive to the instantaneous feedback voltage for comparing the output with the reference, modifying the transistor impedance to limit the output voltage.

Yet a further feature is that the driving potential for the clipping transistor is varied in accordance with current flow therethrough to accomodate variable loading of the power supply.

Another feature is the provision of a drive circuit for the clipper transistor which is DC isolated from the output of the power supply, avoiding high potentials in the regulator.

And a further feature is a regulator circuit having wye connected impedances, as resistors, with which one or more transformer primaries may be connected.

Still another feature is that the level of the regulated voltage is controlled and adjusted in the base drive circuit of the clipper transistor, avoiding adjustable circuit elements in high voltage, high current circuits.

Further features and advantages will readily be apparent from the following specification and drawings, in which.

Figure 1:
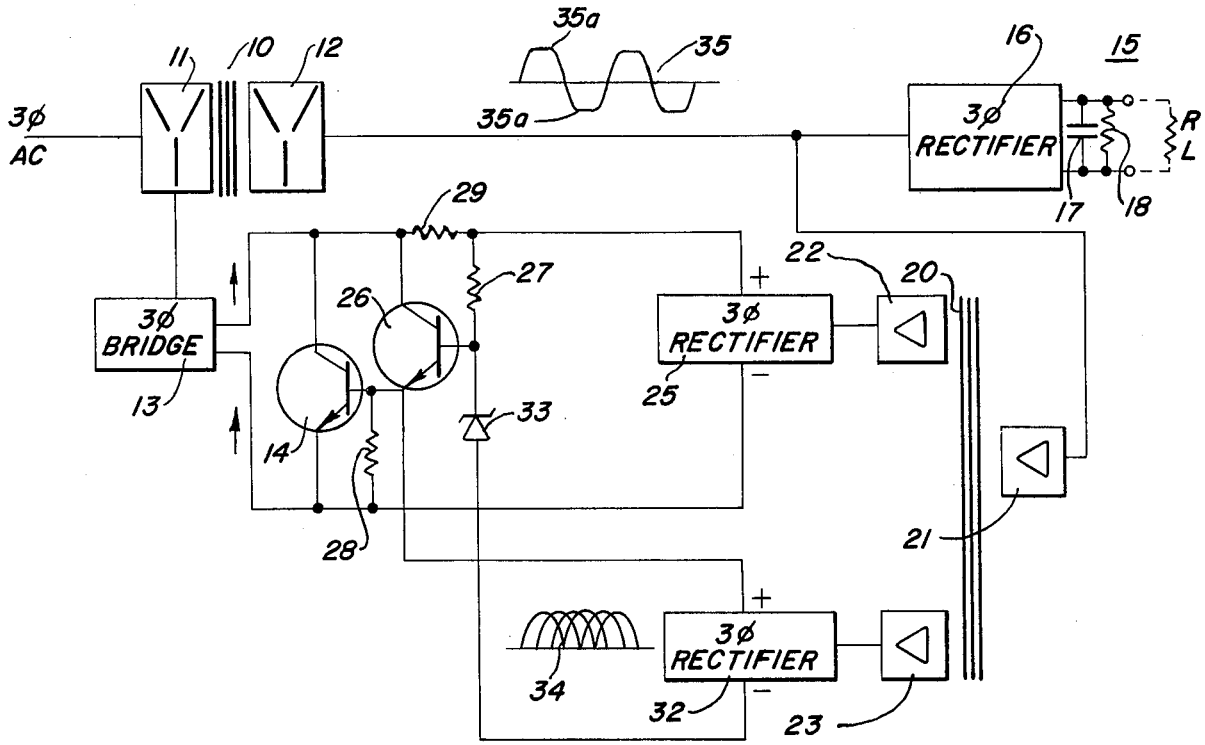
FIG. 1 is a schematic diagram, partially in block form, of a basic form of the invention.

The circuits illustrated in the drawings represent preferred forms of the invention. During the course of the following description, component types and values will be given for many circuit elements. It is to be understood that the specific circuits and components are not to be considered critical unless otherwise indicated. In many of the figures the connections of the three phase transformer windings are not shown, to avoid complicating the drawings.

In FIG. 1 a three phase AC power source is connected with a transformer 10 having wye connected primary and secondary windings 11 and 12, respectively. A three phase bridge circuit 13 is connected with primary winding 11 interconnecting the neutral terminals of the three windings and has connected thereacross a clipping transistor 14, forming a circuit which is isolated from ground for clipping or limiting the voltages appearing across the windings of the primary 11. A load 15 is connected with transformer secondary winding 12 and includes a three phase full wave rectifier 16, a filter network, capacitor 17 and shunt resistor 18, and a load resistor $R_L$.

A three phase transformer 20 has a primary winding 21 connected with the output circuit and a pair of secondary windings 22 and 23. In the circuit illustrated all the windings of transformer 20 are delta connected. They could, if desired, by wye connected or the primary winding could be one form and the secondary windings of the other. It is only necessary that both secondary windings be of the same form. Connected with secondary winding 22 is a three phase full wave recitifier 25 which provides base drive operating potentials for driver transistor 26 and thus for clipping transistor 14. The emitter-collector circuits of transistors 14 and 26 are connected across three phase bridge 13, with the current in the bridge flowing through the transistors. Substantially all the current flows through clipping transistor 14, with transistor 26 merely providing base drive to it. The positive output terminal of recitifier 25 is connected with the base of transistor 26 through resistor 27. The emitter of transistor 26 is connected with the base of transistor 14, and the current through transistor 26 flows through resistor 28, developing the positive drive poetential for transistor 14. Resistor 29, connected between the collectors of transistors 14 and 26 and through resistor 27 with the base of transistor 26, provides an initial turn-on potential for the transistors from bridge 13. The negative terminal of rectifier 25 is connected with the emitter of transistor 14 and through resistor 28 with the emitter of transistor 26.

Secondary winding 23 is connected with a three phase full wave rectifier 32 in a feedback circuit between the output 15 and the clipping circuit. The positive terminal of rectifier 32 is connected with the emitter of transistor 26. The base of transistor 26 is returned through a Zener diode regulator 33 to the negative terminal of rectifier 32.

The outputs of the two rectifiers 25 and 32 are a series of half wave pulses of the character illustrated at 34, having a repetition rate six times the frequency of the source. The output of recitifer 25 forward biases transistors 14 and 26 so that the clipping circuit has a low or negligible impedance and the currents through the phase windings flow as if the clipping circuit were not there. When the instantaneous feedback voltage is sufficient to cause Zener doide 33 to conduct, the drive to transistor 26 is reduced, in turn reducing the drive clipping transistor 14, increasing its impedance and limiting the voltage in the primary of transformer 10. A representative single phase waveform in the output of transformer 10 is illustrated at 35 where the peaks 35*a* of each half wave are clipped. There is no phase transformation through transformers 10 and 20, in the feedback circuit. Accordingly, line to line or phase to phase clipping is performed. If there were a phase transformation, the line to neutral waveform would be clipped.

The neutral terminals of the primary windings 11, three phase bridge 13, clipper transistor 14 and the drive circuit are all isolated from the sytem reference or ground. The potential of the neutral terminals will float above and below ground as the source and load conditions vary. Furthermore, the feedback circuit is DC isolated from the output circuit. This is particularly important in a power supply having a high voltage output as it avoids high potentials in the clipping and three phase supply circuits.

In order to obtain stable no-load regulation, some preloading of the system is desirable. This is provided here by capacitor 17 and resistor 18, which draw a current of the order of 2½% of the full load rating of the power supply.

Figure 2:
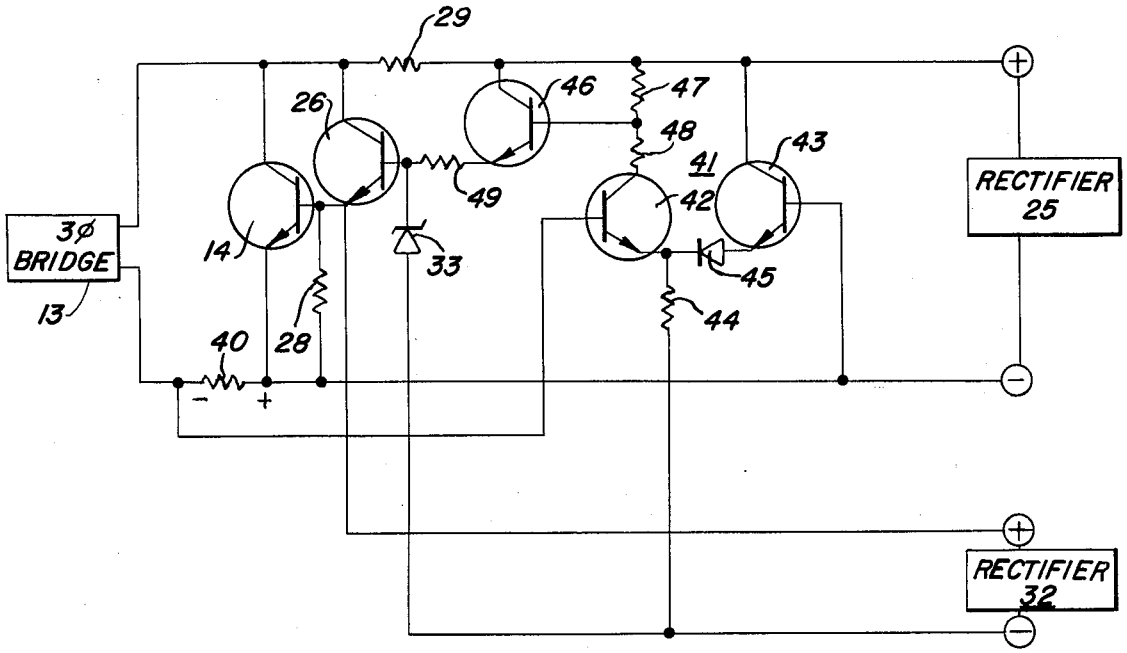
FIG. 2 is a partial schematic diagram of a modified clipping and drive circuit.

Except when the impedance of transistor 14 is increased to clip the voltage waveform, the impedance should be as low as possible so that the voltage across the three phase bridge 13 is essentially zero. It is desirable to provide a means for increasing the base drive of clipping transistor 14 as the load current increases, to avoid power loss in the clipping circuit. The circuit of FIG. 2 provides a means for increasing the drive to the clipping transistor as the current through the clipping transistor, which is a measure of the load current, increases. Elements in FIG. 2 which correspond with elements illustrated in FIG. 1 are given the same reference numeral and the description of FIG. 1 will not be repeated. Only the portion of the regulator circuit between rectifiers 25 and 32 and the three phase bridge 13 is shown.

The current through clipping transistor 14 flows also through current sensing resistor 40 connected in series between the emitter of transistor 14 and three phase bridge 13. A differential transistor amplifier 41 has two transistors 42 and 43 having emitter-collector circuits connected between the positive terminal of three phase rectifier 25 and through a common emitter resistor 44 with the negative terminal of three phase rectifier 32. A diode 45 is connected in series with the emitter of transistor 43. The base of transistor 43 is connected with the positive terminal of resistor 40 while the base of transistor 42 is connected with the negative terminal thereof. Under no-load conditions, with little or no current flowing through resistor 40, the voltages on the bases of transistors 42 and 43 are essentially the same. Transistor 43 is held substantially at cutoff by the voltage drop across diode 45, and transistor 42 conducts heavily. A transistor 46 replaces resistor 27 in the base circuit of transistor 26, and has its base connected to a voltage divider of resistors 47, 48 connected between the positive supply terminal and the collector of transistor 42. As the current through clipping transistor 14 increases, the base of transistor 43 tends to go positive with respect to the base of transistor 42. The current through transistor 42 is reduced and as less voltage is dropped across resistor 47, the base of emitter follower transistor 46 goes more positive, increasing the drive to transistor 46 and through it the drive to transistors 26 and 14. Resistor 49, in series with the emitter of transistor 46, limits the current to the base of driver transistor 26.

Figure 3:
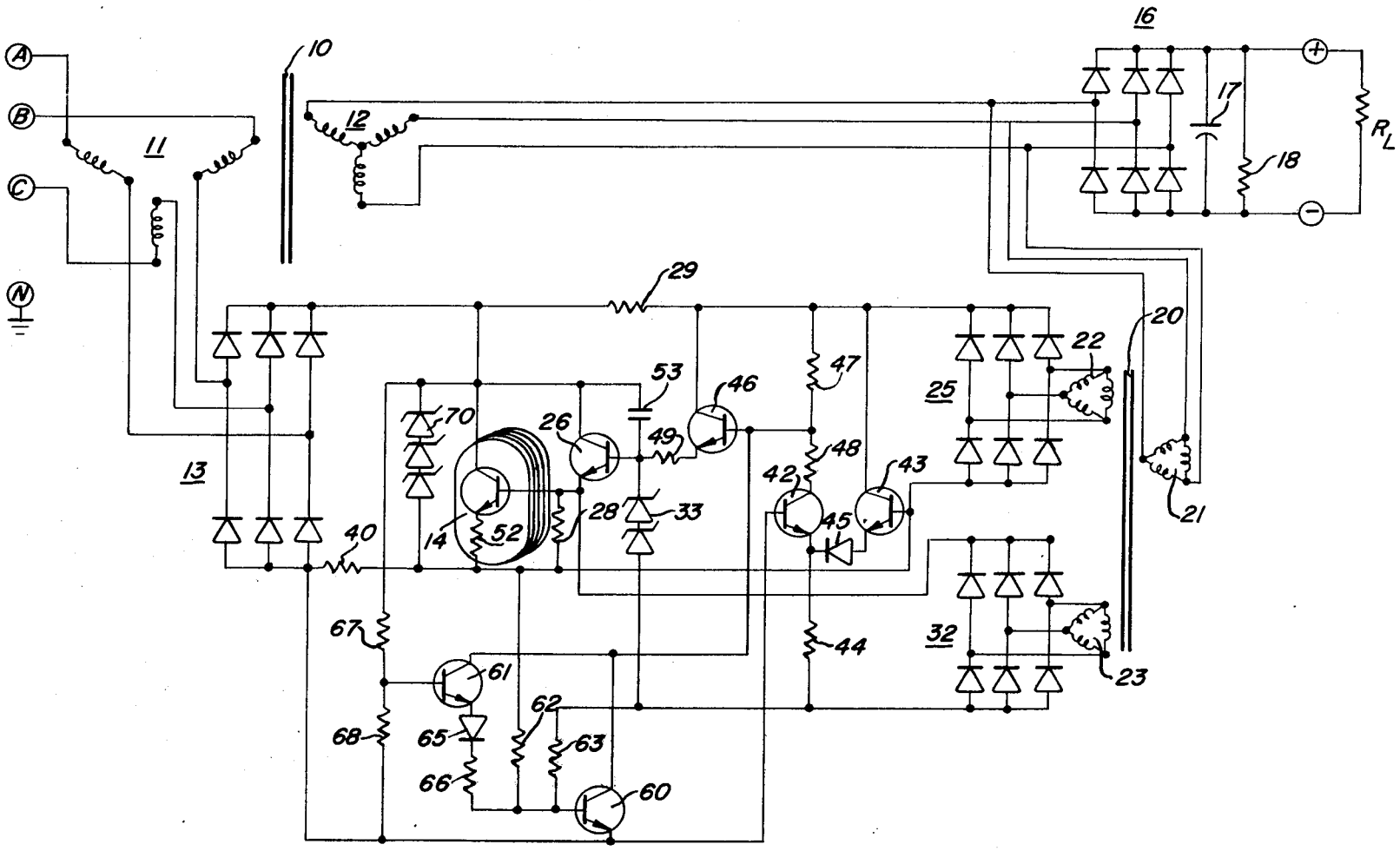
FIG. 3 is a schematic diagram of a preferred embodiment of the invention.

FIG. 3 illustrates a detailed schematic of a power regulator for a supply operated from a three phase 400 Hertz source having a nominal input voltage of 115 volts RMS, from each phase terminal to neutral. The neutral terminals of the windings of transformer primary 11 are isolated from ground, and are interconnected through three phase bridge 13. The current rating for the diodes of bridge 13 is selected to conform with the current rating for the power supply. The wye connected secondary winding 12 of transformer 10 has three phase full wave bridge rectifier 16 connected thereto. Connected across the output of the rectifier are capacitor 17, 300 microfarads, and resistor 18, 50 ohms, which provide sufficient load for stable operation. The drive circuit for the clipping transistor has a three phase full wave bridge rectifier 25 with a nominal DC output of the order of 15 volts. A similar full wave bridge circuit serves as rectifier 32.

Clipping transistor 14 is a Delco type DTS-411 NPN transistor. Where the current rating of the power supply is greater than that which can be handled by one transistor, two or more are connected in parallel. Driver transistor 26 is likewise a Delco type DTS-411, with one driver transistor supplying up to five clipping transistors. Transistors 42, 43 and 46 do not have critical voltage or current requirements and several suitable transistor types are readily available. Resistor 29 provides sufficient positive potential to the transistor 46 to insure turn-on of the circuit, but is preferably as large as possible to afford isolation between the base drive circuit and the clipping circuit, and may be of the order of 10,000 to 20,000 ohms. Current limiting resistor 52, in the emitter circuit of clipping transistor 14, may have a value of the order of 0.3 ohms. Load current measuring resistor 40 similarly may have a value of 0.3 ohms and develop a voltage of the order of 1.5 volts at full load on the power supply. Resistor 28 in the emitter circuit of driver transistor 26 has a value of the order of 13 ohms. Capacitor 53, 0.01 $\mu$f, connected between the collector and base of transistor 26 prevents oscillation during switching. Zener regulating diodes 33 each have a breakdown potential of 6.5 volts, with which the circuit regulates at 13 volts.

In the differential current drive circuit, resistors 47 and 48, forming the voltage divider in the collector circuit of transistor 42, have values of 470 and 330 ohms, respectively, and common emitter resistor 44 has a value of 800 ohms. Current limiting resistor 49, connected in the emitter circuit of emitter follower 46, has a value of 270 ohms.

Transistors 60 and 61 provide overload and overvoltage protection circuits, respectively. Transistor 60 has its emitter collector circuit connected from the junction between resistors 47 and 48 to the base of transistor 42. The base of transistor 60 is returned to the negative terminal of current sensing resistor 40 through resistor 62, 1000 ohms. The base of transistor 60 is also connected through resistor 63, 15,000 ohms, with a negative terminal of feedback rectifier 32. Under normal operating conditions, the voltage divider action of resistors 62, 63 applies a potential to the base of transistor 60 which is negative with respect to the emitter potential and the transitor is cut off. However, if the current through the power regulator becomes excessive, the voltage drop across the resistor 40 increases and transistor 60 conducts. When this occurs, a positive potential is applied, through transistor 60, to the base of transistor 42 causing it to conduct heavily. The voltage to the base of emitter follower transistor 46 is reduced because of the voltage drop through resistor 47, reducing the drive to transistors 26 and 14, increasing the impedance of clipping transistor 14 and severely limiting the input voltage to prevent a damaging short circuit current flowing in the load $R_L$ or in the regulator circuit.

Overvoltage protection transistor 61 has it emitter-collector circuit connected from the base of emitter follower transistor 46, through diode 65 and resistor 66, 1500 ohms, with the base of transistor 60. The base of transistor 61 is connected with a voltage divider made up of resistors 67, 100,000 ohms, and 68, 1650 ohms, connected across the output of three phase bridge 13. In the event of the occurrence of a transient overvoltage condition, a positive potential is applied to the base of transistor 61, causing it to conduct. The voltage drop across diode 65 reduces the voltage differential needed to cause transistor 61 to switch condition. This in turn provides drive to transistor 60, causing it to conduct with the result described above. The overvoltage protection is particularly advantageous in airborne equipment as airborne power systems are more likely to be subject to circuit damaging transient conditions than are the usual commerical power systems.

Zener diodes 70, connected across transistor 14, prevent the application of a damaging voltage across transistor 14.

Figure 4:
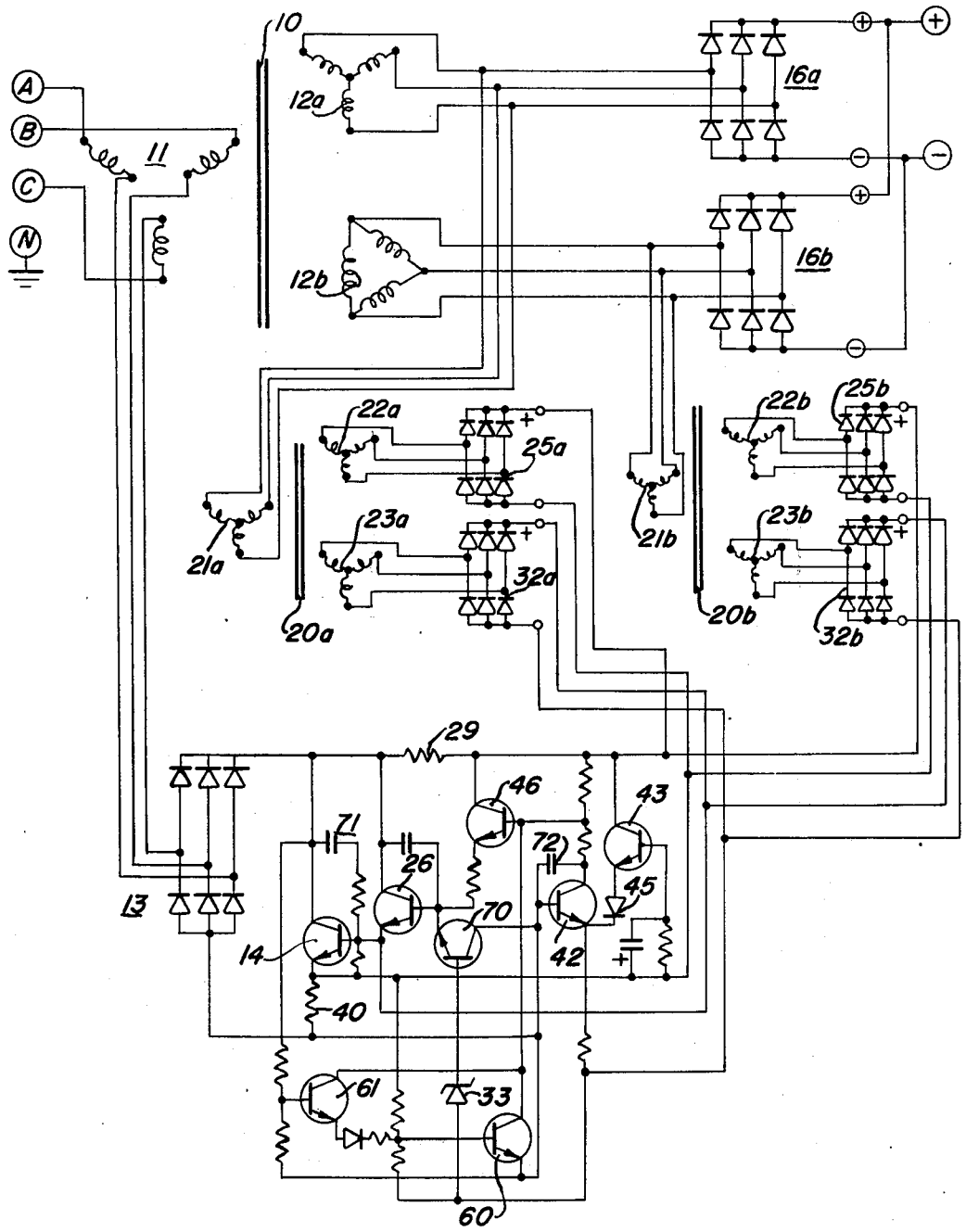
FIG. 4 is a schematic diagram of a circuit providing six phase clipping control.

A further embodiment of the invention with a dual feedback circuit providing six phase clipping is illustrated in FIG. 4. Again, to the extent possible, the circuit elements previously identified are assigned the same reference numerals and will not be described in detail. Transformer 10 is provided with two secondary windings 12*a* and 12*b*. Wye connected secondary 12*a* has a three phase full wave rectifier 16*a* connected thereto, while delta connected secondary winding 12*b* has a three phase full wave rectifier 16*b* connected thereto. The outputs of the two full wave rectifiers are connected together, as will be described below.

Figure 5:
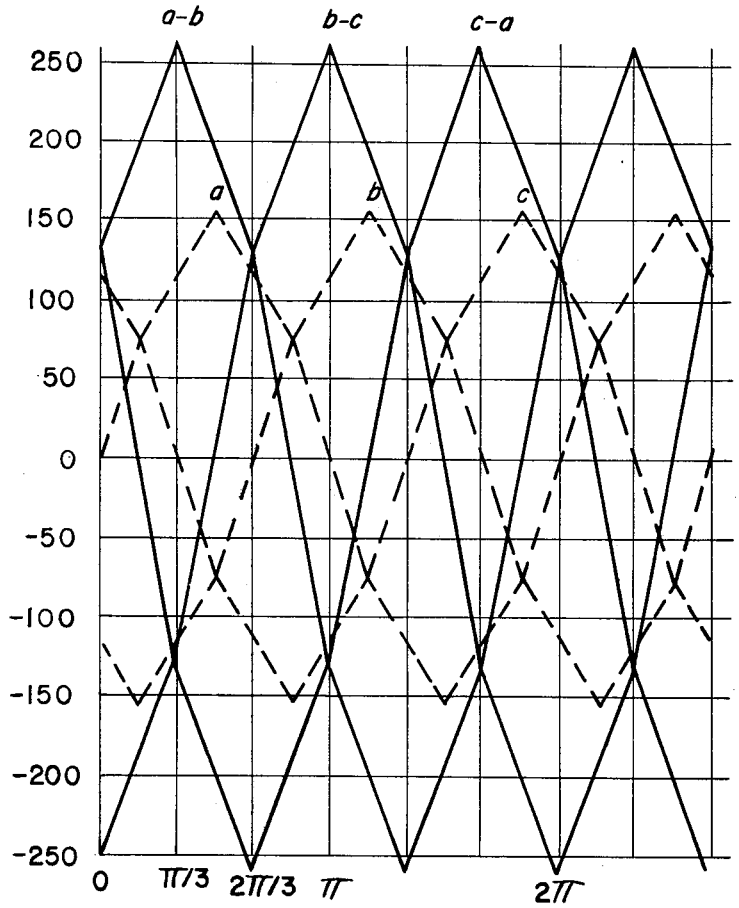
FIGS. 5 and 6 are voltage waveforms which illustrate the operation of the circuit of FIG. 4.
Figure 6:
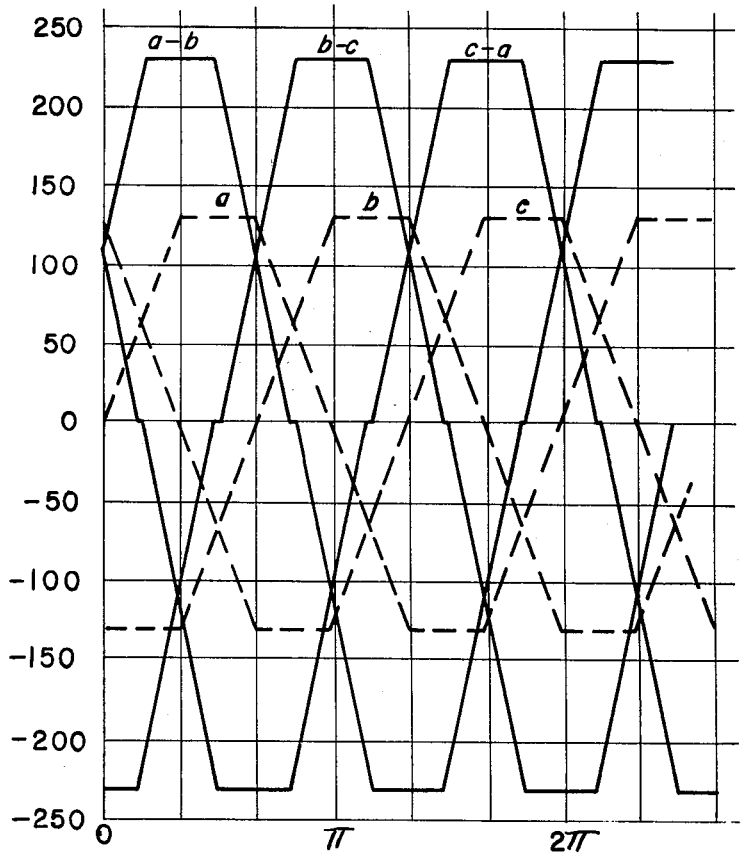

A pair of parallel connected base drive and feedback circuits are provided, which are out of phase with each other, affording six phase rather than three phase control of the primary voltage. The first circuit includes transformer 20*a* having a primary winding 21*a* connected with the output of wye secondary 12*a*. Secondary windings 22*a* and 23*a* of transformer 20*a* are connected with three phase full wave rectifiers 25*a* and 32*a*, providing base drive and feedback voltages for phase-to-phase control of the primary voltage. The second circuit includes transformer 20*b*, the primary winding 21*b* of which is connected with delta secondary 12*b*. Secondary windings 22*b* and 23*b* are connected with three phase full wave rectifiers 25*b* and 32*b*, the outputs of which are connected in parallel with the outputs of rectifiers 25*a* and 32*a*. The voltages in the circuit of transformer 20*b* are displaced in phase from those in the circuit of transformer 20*a* and provide phase-to-neutral clipping in the primary power circuit. The phase conditions are illustrated in FIGS. 5 and 6. In FIG. 5 the solid line curves show the phase-to-phase peak voltage on the primary windings of transformer 10. The broken line curves show the phase-to-neutral peak voltage for each of the three windings. The phase-to-neutral voltages are displaced from the phase-to-phase voltages with the a phase lagging the *a–b* phase by 30° and leading the *b–c* phase by 90°, for example. The voltage amplitudes are based on a source voltage of 115 volts RMS phase-to-neutral. FIG. 6 shows the phase-to-phase and phase-to-neutral voltages clipped at a level of 81°, which effectively eliminates ripple valleys between the phase-to-phase and phase-to-neutral voltages in the output.

The voltage step-down ratios of transformers 20*a* and 20*b* are selected to provide equal voltage outputs from rectifiers 25*a*, 25*b*, 32*a* and 32*b*. Thus, the level of the clipping circuit operation is the same for phase-to-phase and phase-to-neutral clipping.

The combination of wye and delta transformations illustrated in FIG. 4 is only one of many which might be used. Phase-to-phase clipping is achieved when the base drive and feedback signals are in phase with the phase-to-phase voltages in the primary winding 11. Phase-to-neutral clipping is achieved when the base drive and feedback signals are shifted 30° or 60° from the phase-to-phase voltages. The number of wye to delta transformations which are incorporated in each circuit is immaterial. Fig. 4 should be compared with FIG. 3 where transformer 20 is connected for delta-to-delta operation, but is energized from wye-to-wye transformer 10. In this situation there is no phase shift and phase-to-phase clipping is effected.

The outputs of load rectifiers 16*a* and 16*b* are connected in parallel. By virtue of the phase shift between primary winding 11 and secondary winding 12*b* of transformer 10, the full wave rectified pulses from the two rectifiers are displaced in phase from each other. This provides a ripple frequency of 12 times the basic frequency of the system, greatly simplifying filter design.

There are a few differences between the base drive and feedback circuits of FIGS. 3 and 4. The clipping action is made more rapid by the addition of transistor 70 having its emitter-collector circuit connected between the base of driver transistor 26 and the negative terminal of current measuring resistor 40. Zener reference diode 33 is connected with the base of transistor 70 and, when the clipping voltage is reached, turns transistor 70 on providing a rapid switch action that clips the primary waveform more effectively than the Zener diode alone. Filter circuit 71 is connected between the collector and base of clipping transistor 14, to prevent oscillation. Similarly, capacitor 72 is connected between the collector and base of transistor 42 to prevent oscillation.

The primary power regulator described thus far has several advantages over more conventional regulated power supplies, using variable impedance transistors in the output, SCR switching or the like. First of all, the regulation is effected in the primary winding of the power transformer. This reduces the power handling requirements for the transformer, permitting a reduction in size and weight, which are extremely important in airborne equipment. The clipping level can be selected to minimize the ripple frequency amplitude; and as pointed out in connection with FIG. 4, phase-to-phase and phase-to-neutral clipping can be combined to provide a high ripple frequency. The components utilized are not subject to nuclear radiation effects as are SCR's, for example. Protective circuits responding to abnormal current and voltage conditions are easily incorporated.

Figure 7:
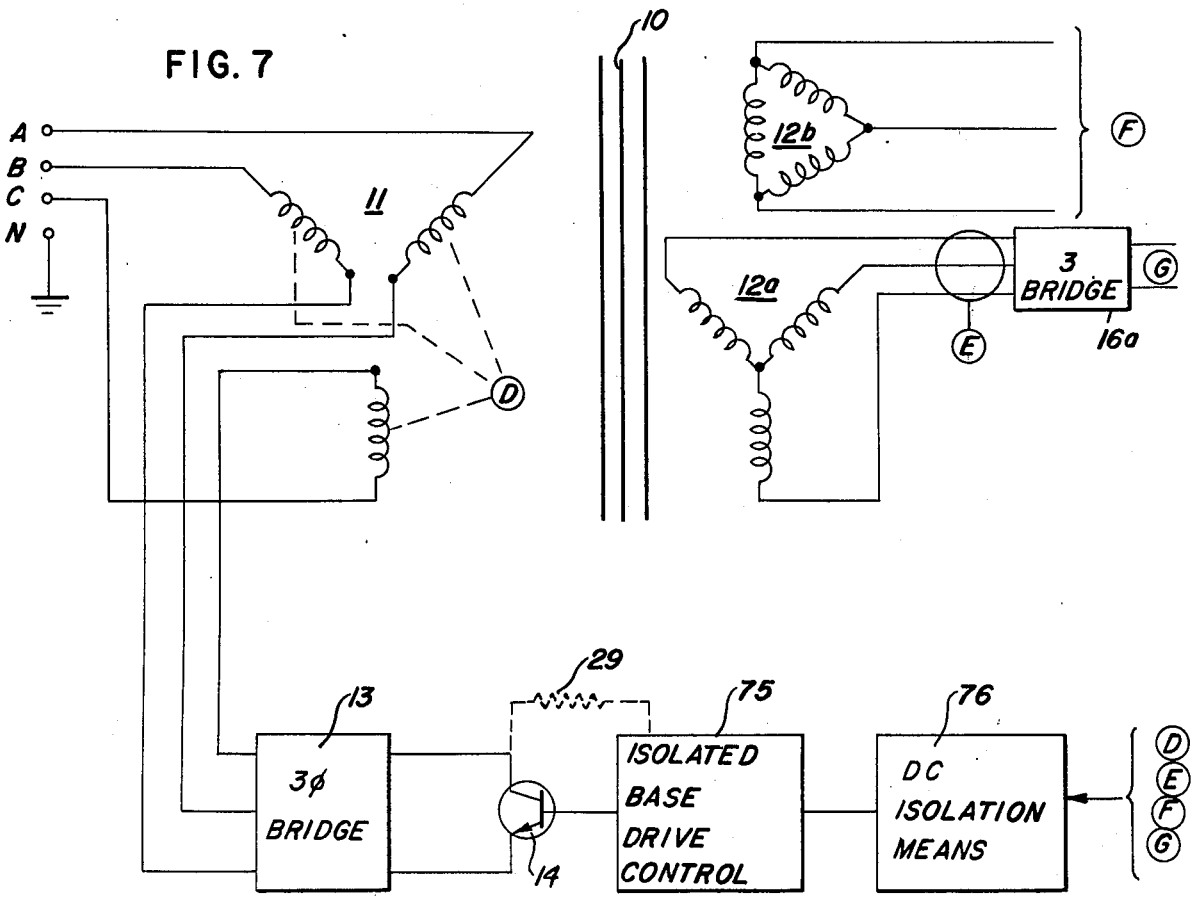
FIG. 7 is a schematic diagram, partially in block form, of another embodiment of the invention in which the clipper drive is derived from the primary.

The power regulator may derive control information from different points in the power supply, depending on the accuracy of regulation desired, the voltage levels of the circuit and corresponding economic control circuit considerations where high voltages are present. In FIG. 7, several alternative possibilities are illustrated. Power transformer 10 has its primary winding 11 connected in a wye configuration to three phase source terminals A, B, C. The source neutral terminal N is grounded. The neutral terminals of each of the windings of transformer primary 11 are isolated from ground and are connected with three phase diode bridge 13 across which clipper transistor 14 is connected. Transformer 10 is illustrated as having two secondaries, 12*a*, a wye connected circuit feeding a three phase bridge rectifier 16*a* which in turn has a DC output, and 12*b* a delta connected circuit having a three phase AC output.

Clipper transistor 14 is actuated by a base drive control circuit 75 which is isolated from ground and which has a control voltage input through a DC isolation circuit 76. The input control voltage may be alternating signal, as in FIG. 1, and may be derived from transformer primary winding 11 as indicated at D or may be derived from transformer secondary windings 12*a* or 12*b*, as indicated at E and F. Alternatively, a DC control voltage may be derived from the output of three phase bridge rectifier 16*a*, as indicated at G. Control of the regulation based on the primary winding voltage, as indicated by D compensates only for source variations, line transients and losses in the primary winding. In some case, incomplete regulation based on the primary voltage of sufficient in order to avoid other problems which would be introduced by connecting the base drive control 75 with the supply outputs, E, F, G. Controls based on the alternating voltages E, F provide closer regulation by taking into account transformer losses. The most accurate control is achieved by utilizing the output of rectifier 16*a*, at G. Here, however, special circuitry must be utilized in the DC isolation means 76. Representative circuits will be discussed below.

Resistor 29 provides a start-up potential from the primary circuit to the base drive controls 75 where the control voltage is derived from the output of transformer 10.

Figure 8:
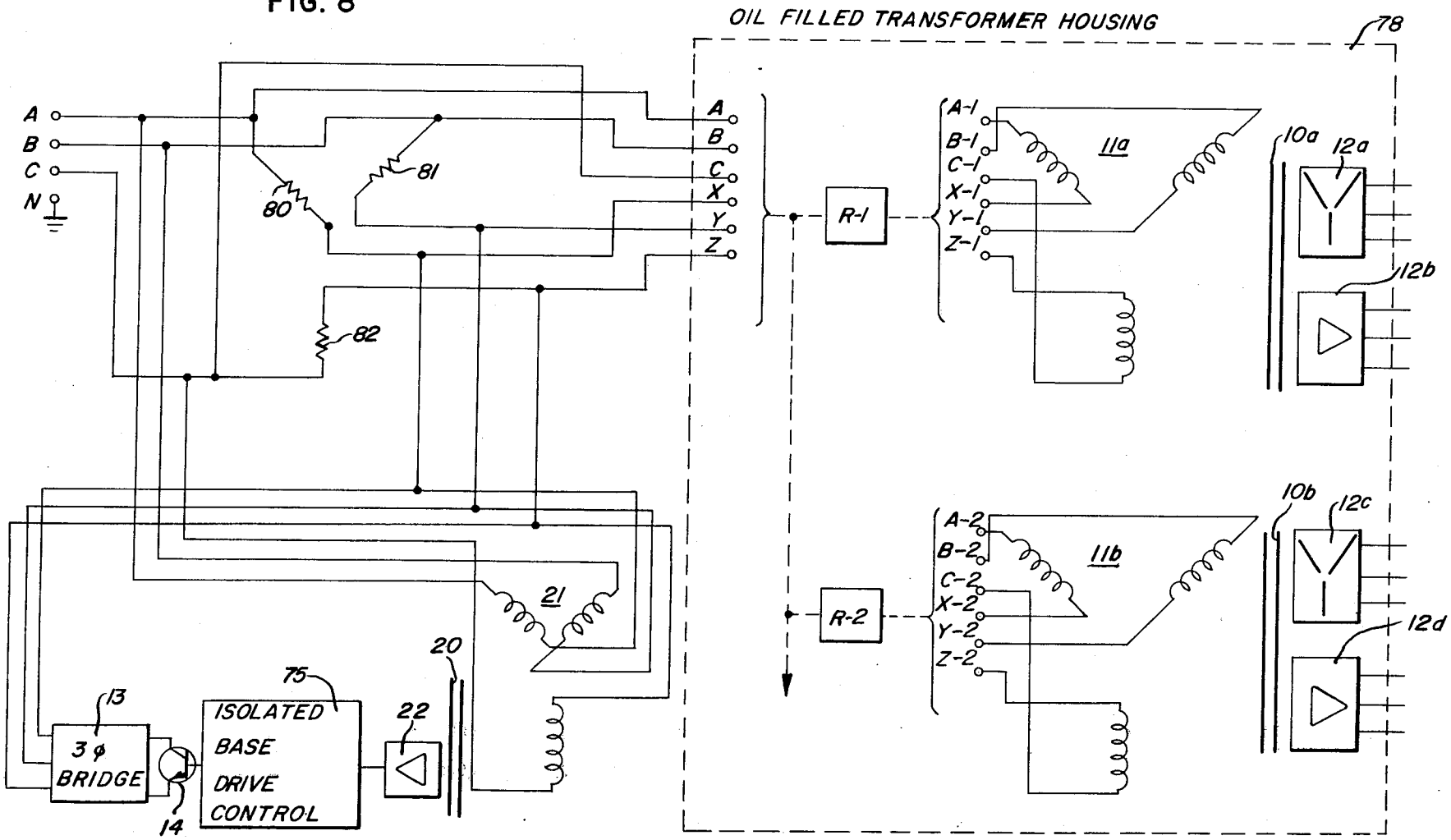
FIG. 8 is a schematic diagram, partially in block form, in which the clipper drive is derived from the primary and the regulating circuit is isolated from the power transformers.

An embodiment of the regulator which is particularly adapted for a multi-section high voltage power supply is illustrated in FIG. 8. In a high voltage system having primary voltages of the order of 110 or 220 volts per phase and output voltages of several thousand volts, it is common for the voltage stepup transformers to be located in an oil filled housing providing isolataion, cooling and a high impedance between the windings and the transformer core and between the primary and secondary windings. Power supply switching is between the primary windings of the transformers and the power source to avoid switching in the high voltage secondary circuits. Commonly, the switching is achieved by multipole relays which are also located in the oil filled transformer housing so that the only connections to the oil filled housing are the phase terminals from the power source and the control circuits for the switching relays. The present invention enables regulation of such a power supply without direct electrical connection to the high voltage circuits and with minimal additional circuitry within the oil filled transformer housing.

In FIG. 8 the power supply transformers 10*a*, 10*b* are located within an oil filled housing 78. Additional transformers may be provided depending on the supply requirements. Phase terminals A, B, C on the housing are connected directly with the phase terminals A, B, C of a three phase source, the source neutral terminal N being grounded. Terminals X, Y, Z, representing the neutral ends of the individual phase windings of the transformer primaries are also provided at the transformer housing. Within the housing relays R1 and R2 are provided which may be actuated by a suitable control circuitry (not shown) to connect the primary windings 11*a*, 11*b* of transformers 10*a*, 10*b* with terminals A, B, C and X, Y, Z. The regulator circuit is provided entirely outside the transformer housing. Three impedance elements 80, 81, 82 are connected, respectively, between terminals A–X, B–Y and C–Z. The impedance elements 80, 81 and 82 are thus effectively in parallel with the three phase primary windings 11*a*, 11*b*, 11*c*, etc. The impedance elements 80, 81 and 82 are preferably resistors but may be inductors or capacitors.

The primary power regulator circuit is connected with the impedance elements 80, 81, 82 and by regulating the voltage across these elements also regulates the voltage across the primary windings of the transformers which are connected in parallel therewith. The three phase diode bridge 13 is connected with the neutral terminals X, Y, Z of the three phase impedances and has the clipper transistor 14 connected in series therewith, as explained above. Regulator input transformer 20 has primary windings 21 which are connected in parallel with the three phase impedances 80, 81, 82. The secondary windings 22 provide the input or base drive control 75, actuating clipper transistor 14. The regulator circuit is responsive to the individual phase voltages, providing regulation for changes in condition in the three phase source and eliminating the effects of transients on the power line. The various sections of the power supply, represented by transformers 10*a*, 10*b*, etc. may be connected and disconnected without disrupting the operation of the regulator.

Figure 9:
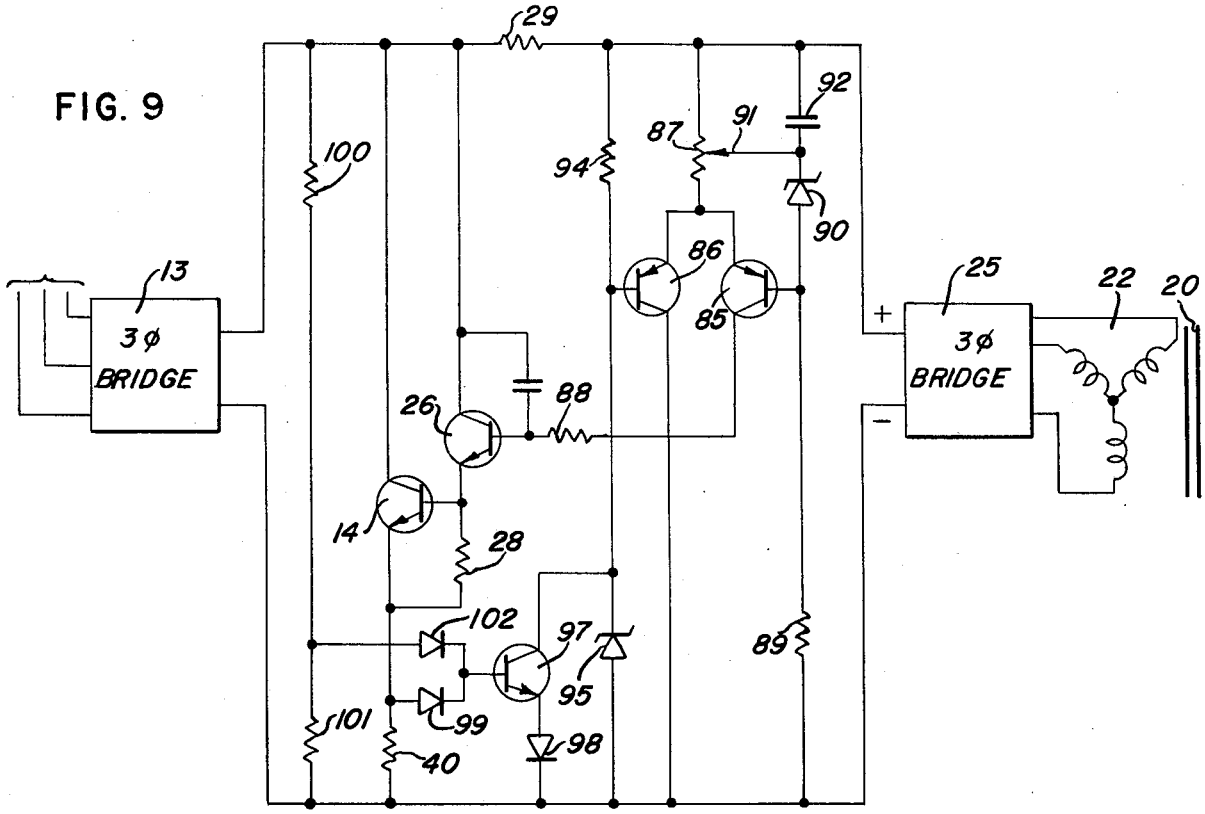
FIG. 9 is a schematic diagram of the drive control circuit of FIG. 8.

The base drive control circuits of FIGS. 1–4 utilize two separate DC power sources, one for drive to the clipper transistor and the other for regulation. These functions can be combined with a single DC source as shown in FIG. 9. Three phase diode bridge 13 is connected with the isolated neutral terminals of the primary winding of a power transformer as shown in FIG. 3. Transformer 20 has a primary winding (not shown) which may be connected with an output of the power transformer, also as shown in FIG. 3. Clipper transistor 14 is connected across diode bridge 13 through a current sensing resistor 40. Driver transistor 26 has its collector-emitter circuit connected with the collector-base circuit of clipper transistor 14, providing base drive to the clipper transistor. The collector-emitter circuit of transistor 26 is completed through resistor 28 connected between the base and emitter of clipper transistor 14. So long as transistors 26 and 14 are biased for maximum conduction the power supply operates without regulation.

The feedback voltage is connected through transformer 20 and secondary windings 22 with a three phase rectifier 25 having a DC output of the polarity indicated, and an amplitude which represents the output amplitude of the power transformer.

The remainder of the circuit is somewhat diffferent from that of FIGS. 1–4 and new reference numerals will be assigned.

The control signal for driver transistor 26 is provided by a differential amplifier including transistors 85, 86, the emitters of which are connected together and through resistor 87 with the positive DC terminal. The collector of transistor 85 is connected through current limiting resistor 88 with the base of driver transistor 26. The base of transistor 85 is returned to the negative DC terminal through resistor 89 and is connected through a Zener diode 90 with a tap 91 on emitter resistor 87. A capacitor 91 filters the voltage applied to the base of transistor 85 to improve stability during transient condition. The other half of the differential amplifier, transistor 86, has its base connected with the positive supply terminal through resistor 94 and returned to the negative terminal througn Zener diode 95.

So long as the DC voltage from rectifier bridge 25 is insufficient in amplitude to cause Zener diode 95 to conduct, the positive potential applied to the base of transistor 86 renders it nonconductive. If the voltage is also insufficient to cause Zener diode 90 to conduct, the negative voltage applied to the base of transistor 85 through resistor 89 causes it to conduct with the current being limited primarily by resistors 87, 88, providing maximum drive to transistors 26 and 14. In this condition of the circuit, the power supply is not limited.

The setting of potentiometer tap 91 determines the supply voltage at which Zener diode 90 conducts. When this occurs, the voltage at the base of transistor 85 is reduced, reducing its conduction and the drive to clipper transistor 14, effecting regulation. Should the feedback voltage cause Zener diode 95 to conduct, transistor 86 conducts cutting off transistor 85, driver transistor 26 and clipper transistor 14.

Transistor 97, having its collector-emitter circuit connected between the base of transistor 86 and through diode 98 to the negative supply terminal, provides overcurrent and overvoltage protection. Transistor 97 is cut off during normal operating conditions. In the event of an overcurrent condition, the potential developed across resistor 40 by the current through clipper transistor 14 is applied through diode 99 to the base of transistor 97, causing it to conduct. This effectively connects the base of transistor 86 with the negative supply terminal, causing it to conduct and cutting off transistor 85 which supplies base current to the driver transistor 26, in turn cutting off clipper transistor 14. A pair of resistors 100, 101 are connected in parallel with clipper transistor 14 across three phase diode bridge 13. A diode 102 is connected from the junction to resistors with the base of transistor 97. In the event of an overvoltage condition across the clipping transistor, diode 102 conducts causing transistor 97 to conduct and interrupting the drive to clipper transistor 14 as described above.

Figure 10:
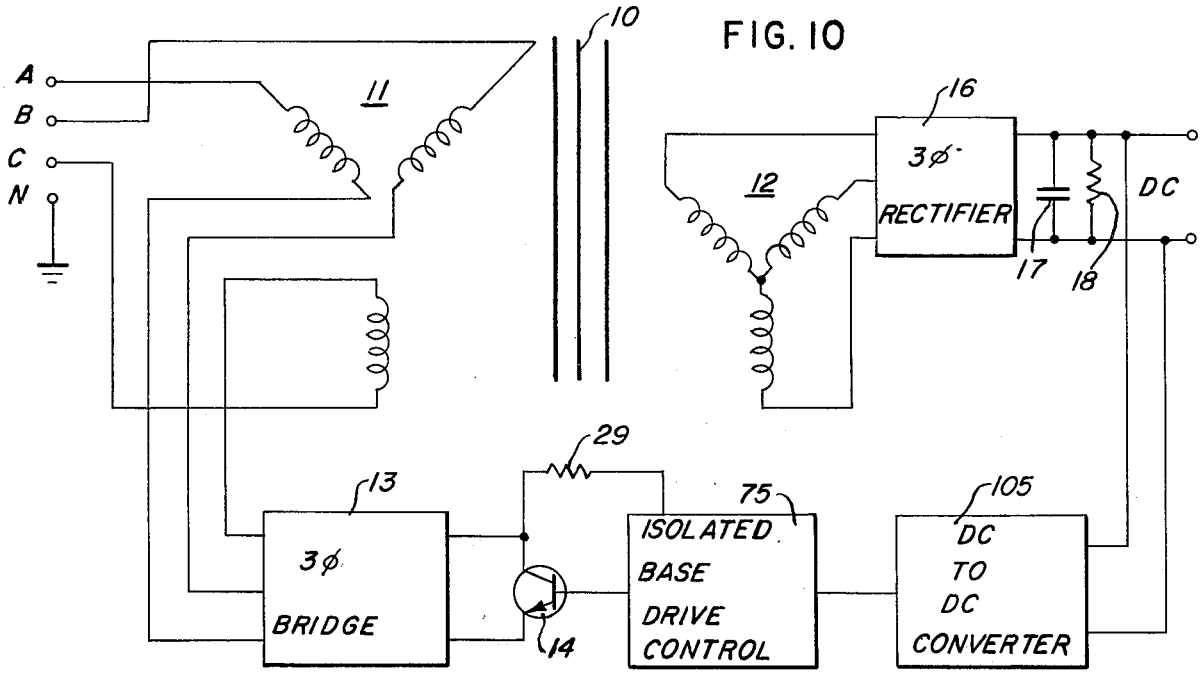
FIG. 10 is a schematic diagram, partially in block form, of an embodiment of the invention in which the DC output controls the regulator.

A preferred form of a low voltage power supply system is illustrated in FIG. 10. The primary windings 11 of power transformer 10 are connected with the three phase source and the neutral terminals of the primary windings are connected through three phase diode bridge 13 with clipper transistor 14. The secondary winding 12 of the power transformer is connected with the three phase AC to DC rectifier 16, the output of which is filtered by capacitor 17 and resistor 18, providing a DC output for supplying a load. The control input for the isolated base drive control circuit 75 is obtained directly from the DC power supply output through a DC to DC converter 105, which provides a DC feedback control to the base drive control circuit, without a direct DC connection which would destroy the isolation of the base drive and clipper circuits.

Figure 11:
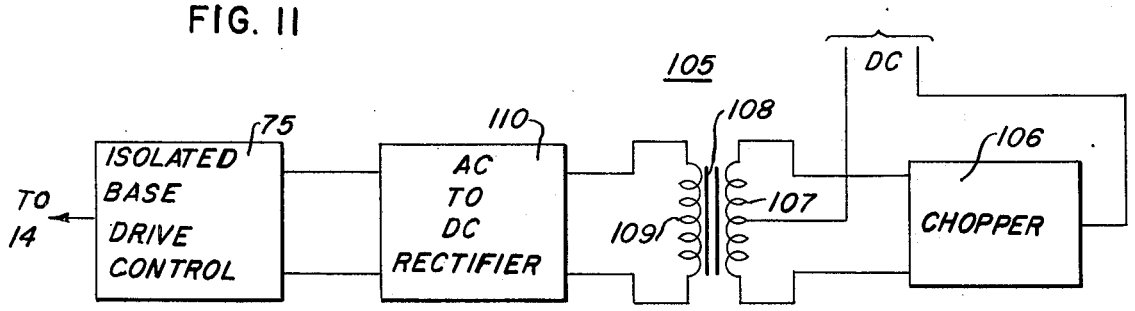
FIG. 11 is a fragmentary block diagram of one embodiment of FIG. 10.

One form of the DC to DC converter 105 is illustrated in FIG. 11. Here the DC output potential from the power supply is connected through a chopper circuit 106 where it is converted into an alternating signal having an amplitude which is a function of the DC voltage level, to the primary winding 107 of a coupling transformer 108. The secondary winding 109 of the coupling transformer is connected with a rectifier 110 which provides a DC control voltage for the isolated base drive control circuit 75.

Figure 12:
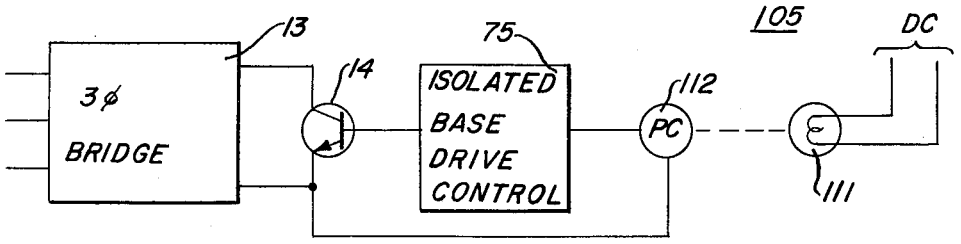
FIG. 12 is a fragmentary block diagram of another embodiment of FIG. 10.

Another DC to DC converter is illustrated in FIG. 12. Here the DC voltage from the regulated supply is connected with an incandescent lamp 111. The light from the lamp, which has an intensity that varies with the DC voltage level, actuates a photocell 112, the output of which is connected with base drive control 75.

I claim:

1. A three phase primary power regulator, comprising:

a source of three phase power;

means defining a common ground reference potential;

three impedance elements connected with said source, forming a three phase, wye connected circuit, each impedance element having its neutral terminal isolated from the neutral terminals of the other impedance elements and from said reference potential means;

a three phase full wave diode bridge circuit connected with the neutral terminals of said wye connected impedance elements and isolated from said reference potential means;

a variable impedance device having an impedance which is generally continuously variable from a low value to a high value in accordance with a control voltage applied thereto, connected with said three phase bridge circuit and in series with said elements across said source;

an output circuit for deriving energy from said impedance elements; and a feedback circuit, isolated from said reference potential means, responsive to voltage across said impedance elements to control the impedance of said variable impedance device between said low value and said high value to regulate the energy derived in the output circuit, maximum energy being derived when the impedance of the device is low, and the peaks of voltage and current of each of the three power phases from said source being clipped as the impedance of the device increases from the low value to the high value.

2. The primary power regulator of claim 1 in which said feedback circuit is connected from the output circuit to said variable impedance device.

3. The primary power regulator of claim 1 in which said feedback circuit is connected from said impedance elements to said variable impedance device.

4. The primary power regulator of claim 1 in which said impedance elements form the primary windings of a three phase transformer.

5. The primary power regulator of claim 1 in which said impedance elements have the primary windings of a three phase transformer connected in parallel therewith.

6. The primary power regulator of claim 1 having two three phase feedback circuits, one displaced in phase from the other, to provide six phase limiting of the voltage to said output circuit.

7. The primary power regulator of claim 1 including means responsive to excessive current through said variable impedance device to limit the voltage to said output circuit.

8. The primary power regulator of claim 1 including means responsive to excessive voltage from said source, connected to said variable impedance device to limit the voltage to said output circuit.

9. The primary power regulator of claim 1 in which said feedback circuit includes a voltage reference, means for comparing the instantaneous feedback voltage with said reference, and means for increasing the impedance of said device to limit the voltage to the output circuit when the feedback voltage exceeds said reference.

10. The primary power regulator of claim 1 in which said variable impedance device is a variable impedance transistor connected across said three phase bridge circuit, and in which said feedback includes a base drive circuit for the transistor, responsive to voltage across the impedance elements, increasing the impedance of said transistor, as a function of the voltage, to limit the output voltage.

11. The primary power regulator of claim 10 in which said feedback circuit is in phase with the source, providing phase-to-phaase clipping.

12. The primary power regulator of claim 10 in which said feedback circuit includes a wye-to-delta transformer, providing phase-to-neutral clipping.

13. The primary power regulator of claim 10 having two feedback circuits, one in phase with the source, providing phase-to-phase clipping, and the other including a wye-to-delta transformer, providing phase-to-neutral clipping.

14. The primary power regulator of claim 1 having a plurality of output circuits connected with said impedance elements, in which said feedback circuit is connected from only one of the output circuits to said variable impedance device, regulating the voltage to all of the output circuits.

15. The primary power regulator of claim 14 in which one of said output circuits is wye connected and another of the output circuits is delta cconnected, the regulator also including two full wave rectifiers, one connected with each output circuit, and means connecting the outputs of said full wave rectifiers together, affording a combined output with an effective ripple frequency six times the source frequency.

16. The primary power regulator of claim 10, wherein the feedback circuit includes a source of operating potential connected with said transistor and a circuit for applying a potential to the base of the transistor to cause it to conduct, means establishing a reference potential and means responsive to the voltage across said impedance elements and to said reference to change the potential at the base of said transistor, increasing its impedance, limiting the instantaneous voltage to the output.

17. The primary power regulator of claim 16 wherein said source of operating potential includes a three phase full wave rectifier connected with the output circuit and having the emitter-collector circuit of said transistor connected thereacross.

18. The primary power regulator of claim 1 in which said variable impedance device is a clipping transistor having an emitter-collector circuit connected in a series with said bridge circuit, said regulator further including means applying a potential to the base causing the transistor to conduct, and means responsive to current flow through said transistor to vary the potential of the base and modify the transistor impedance.

19. The primary power regulator of claim 18 in which a resistor is connected in series with said clipping transistor and the means responsive to current flow is connected across the resistor and is responsive to the voltage developed by the current flowing therethrough.

20. The primary power regulator of claim 19 in which the means responsive to the voltage across said resistor includes a differential transistor amplifier having two transistors with a common emitter resistor, the bases of the transistors being connected across the resistor in series with the clipping transistor, and means responsive to the current through one of said differential transistors for varying the base potential of said clipping transistor in accordance with the current therethrough.

21. The primary powr regulator of claim 1 in which said variable impedance device is a clipping transistor having an emitter collector circuit connected in series with said bridge circuit and a base drive circuit connected with the base of said clipping transistor to control its impedance and the current flow therethrough, said circuit further including means sensing an abnormal electrical condition and connected with said base drive circuit to increase the impedance of said clipping transistor upon the occurrence of such abnormal condition.

22. The primary power regulator of claim 21 wherein said sensing means includes a sensing transistor having its output connected with the base drive circuit of the clipping transistor and normally nonconducting, said sensing transistor having its input connected with means responsive to the source voltage and to the clipping transistor current, said sensing transistor being rendered conductive by abnormal source voltage or clipping transistor current, to reduce the drive to the clipping transistor.

23. The primary power regulator of claim 2 in which said feedback circuit is DC isolated from said output.

24. The primary power regulator of claim 23 in which said feedback circuit is AC coupled to said output.

25. The primary power regulator of claim 23 in which said output circuit includes an AC to DC rectifier, and said feedback circuit includes an energy transducer responsive to DC for coupling a signal to said variable impedance device.

26. The primary power regulator of claim 5 including switch means connecting the primary winding of the three phase transformer to said impedance elements.

27. The primary power regulator of claiam 26 including an oil filled transformer housing having the primary windings for a plurality of transformers therein, six terminals on said housing connected with the terminals of said three impedance elements, and switch means in said housing connecting said transformer windings with said terminals, and wherein said feedback circuit is connected to said impedance elements.

28. The primary power regulator of claim 27 in which said feedback circuit includes means for adjusting the level of energy regulation of said variable impedance device.

29. The primary power regulator of claim 1 including means for adjusting the level of energy regulation of said variable impedance device.

30. The primary power regulator of claim 9 including means for adjusting the relationship between the voltage reference and the feedback voltage to control the level of energy regulation of said variable impedance device.

* * * * *